US006161357A

United States Patent [19]

Altemus

[11] Patent Number: 6,161,357

[45] Date of Patent: Dec. 19, 2000

[54] BIDIRECTIONALLY INTERLOCKING, HOLLOW BRICK WALL SYSTEM

[76] Inventor: Armin J. Altemus, P.O. Box 53264, Riverside, Calif. 92517-4264

[21] Appl. No.: 09/510,491

[22] Filed: Feb. 23, 2000

Related U.S. Application Data

[63] Continuation of application No. 09/161,552, Sep. 25, 1998, abandoned.

[51] Int. Cl.[7] ..... E04B 2/18

[52] U.S. Cl. ..... 52/592.6; 52/604; 52/605; 52/607; 52/220.2; 52/286; 52/505; 52/570; 52/741.13; 446/124

[58] Field of Search ..... 52/604, 605, 606, 52/607, 220.2, 220.3, 286, 503, 505, 561, 570, 592.6, 741.13, 745.11; 446/85, 117, 122, 124, 125

[56] References Cited

U.S. PATENT DOCUMENTS

| | | | |
|---|---|---|---|
| 786,884 | 4/1905 | Faulkner | 52/289 |
| 800,385 | 9/1905 | Miller | 52/289 |
| 950,140 | 2/1910 | Lucke | 52/505 |
| 1,242,087 | 10/1917 | Waddell | 52/592.5 |
| 2,911,818 | 11/1959 | Smith | 52/592.3 |
| 4,426,815 | 1/1984 | Brown | 52/100 |
| 5,421,135 | 6/1995 | Stevens et al. | 52/604 |
| 5,457,926 | 10/1995 | Jensen | 52/604 |
| 5,651,642 | 7/1997 | Kelley, Jr. et al. | 405/286 |

*Primary Examiner*—Beth A. Stephan
*Assistant Examiner*—Brian E. Glessner
*Attorney, Agent, or Firm*—Norton R. Townsley

[57] ABSTRACT

A brick with, preferably, two or three cylindrical passageways running from top to bottom, a cylindrical passageway running from one end to the opposite end, two linear grooves at one end and two linear projections at the other end which are of identical shape, and annular projections centered around the bores at top and annular grooves centered around the bores at the other side which are of identical shape. These passageways intersect, the linear grooves are slightly larger than the linear projections, and the annular grooves are slightly larger than the annular projections. The linear projections and grooves are spaced apart from the end-to-end cylindrical passageway, run from top to bottom and are preferably designed with a break for ease of assembly. When a group of bricks of are assembled into a wall, they will interlock in two different planes and will include interconnecting passageways in two planes. The bricks of this invention can be reinforced with rods or posts or filled with concrete or both. The passageways in the brick of this invention can additionally or alternatively be used for installation of plumbing or electrical supply lines and the like. As an added feature of this invention is that bricks of this invention can be assembled at other than right angles at the corners.

36 Claims, 9 Drawing Sheets

BIDIRECTIONALLY INTERLOCKING, HOLLOW BRICK WALL SYSTEM

REFERENCE

This application is a continuation of application Ser. No. 09/161,552 filed Sep. 25, 1998 now abandoned.

BACKGROUND OF THE INVENTION

The present invention relates to the field of brick walls and more specifically to walls made of hollow bricks which interlock and include internal, interconnecting passageways in two planes.

Bricks have been used for millennia for the construction of buildings. For most of that history, bricks have been made solid and of clay or similar materials. This required overlapping courses during construction so as to produce adequate strength. However, brick walls lack earthquake resistance because there is no structural connection between bricks. More recently, it has been possible to make bricks from more convenient materials, such as concrete. This has allowed fabrication of hollow bricks. Several varieties of hollow bricks are currently on the market. Such bricks generally have two chambers in the interior of the brick. To achieve structural rigidity, walls made with such bricks must be constructed over reinforcing rods, especially in areas prone to earthquakes.

A number of patents for hollow interlocking bricks have been issued over the years. U.S. Pat. No. 786,884 discloses a brick with a raised rib around an aperture or passageway on one side or end and a rabbet around the same aperture or passageway in the opposite side or end. The Figures of the '884 patent only show rectangular apertures, ribs and rabbets.

A number of innovations in hollow brick design have been introduced. U.S. Pat. No. 1,522,881 discloses interlocking bricks composed of two brick members connected by connecting members and having matching grooves and ribs on adjacent sides. The structure creates apertures from end to end and side to side.

U.S. Pat. No. 3,030,093 discloses interlocking bricks having circular openings and notches with ribs at one side and grooves at the other side.

U.S. Pat. No. 4,150,717 discloses tiles having a plurality of equally spaced through apertures, and side and corner notches. The tiles have diagonal grooves on one side and diagonal ribs on the other side. The grooves and ribs extend between adjacent apertures.

U.S. Pat. No. 5,634,313 discloses octagonal, hollow bricks with recesses in their bottom surfaces and ribs in their upper surfaces. The structure creates apertures from end to end and side to side.

With rectangular bricks, when it is desired to create a corner with an angle of other than 90°, there is always an angular gap or overlaps at this corner. When walls are made of hollow bricks, they can be reinforced with rods or posts or filled with concrete or both. None of the above listed innovations is intended to be used in this way. Furthermore, none of the above listed innovations interlocks in two different planes. Moreover, none of the above listed innovations provides interconnecting passageways in two planes. Lastly, none of the passageways in the above listed innovations can be used for installation of plumbing or electrical supply lines and the like.

Development of a hollow brick which interlocks in two different planes and provides interconnecting passageways in two different planes represents a great improvement in the field of brick design and satisfies a long felt need of the builder.

SUMMARY OF THE INVENTION

The present invention is a brick with, preferably, two or three vertical cylindrical passageways running from top to bottom and a horizontal cylindrical passageway running from one end to the opposite end. The vertical and horizontal passageways intersect.

There are annular projections centered around the vertical passageways at the top and annular grooves centered around the vertical passageways at the bottom. These projections and grooves are of identical shape but the grooves are slightly larger than the projections.

The invention also has two, parallel, linear grooves at one end and two, parallel, linear projections at the other end which are of identical shape. However, the linear grooves are slightly larger than the linear projections. The linear projections and grooves are spaced apart, bilaterally, from the end-to-end horizontal, cylindrical passageway, run from top to bottom and are preferably designed with a break for ease of assembly.

The width and height of the bricks with two vertical passageways are about half the length. The width and height of the bricks with three, vertical passageways are about one third the length. Also, the bricks with three vertical passageways are about one third longer than the bricks with two vertical passageways. Consequently, when a group of bricks of are assembled into a wall, alternate use of two and three passageway bricks in each course will result in a wall with overlapping bricks and rectangular openings. The bricks will also interlock in two different planes and will include interconnecting passageways in two planes. Thus the bricks of this invention can be reinforced with rods or posts or filled with concrete or both. The passageways in the brick of this invention can additionally or alternatively be used for installation of plumbing or electrical supply lines and the like. As an added feature of this invention, because the annular projections and grooves are circular, bricks of this invention can be assembled at other than right angles at the corners.

The bricks of this invention have two different means of interlocking in the two different planes. In one plane the bricks interlock with annular grooves and projections, and the in the other plane the bricks interlock with linear grooves and projections. In contrast, if one looks closely at the '884 patent, one will see that the means for interlocking from side to side and end to end are the same. In each case the means for interlocking is a raised rectangular rib around an aperture or passageway on one side or end and a rectangular rabbet around the same aperture or passageway in the opposite side or end. It should be noted that the ribs and rabbets on both the sides and the ends form continuous closed figures.

In the instant invention, the positions of the linear projections and grooves are not related to the position or size of the end to end passageway. These projections and grooves run from top to bottom in straight lines and thus cannot form closed figures. Consequently, the instant invention is not the same as and not anticipated by the '884 patent.

An appreciation of the other aims and objectives of the present invention and an understanding of it may be achieved by referring to the accompanying drawings and description of a preferred embodiment.

BRIEF DESCRIPTION OF THE DRAWINGS

FIG. 7A shows two bricks with two vertical passageways assembled vertically with an approximately 90° corner.

FIG. 7B shows two bricks, one having two vertical passageways and the other having three vertical passagways, assembled vertically with an approximately 45° corner.

FIG. 7C shows two bricks, each having three vertical passageways, assembled vertically with an approximately 120° corner.

FIG. 7D shows two bricks, each having three vertical passageways, assembled vertically with an approximately 90° corner.

FIG. 7E shows two bricks, each having three vertical passageways, assembled vertically with an approximately 45° corner.

FIG. 7F shows three bricks, two having two vertical passageways and one having three vertical passageways, assembled vertically in an approximately Z shaped configuration.

DETAILED DESCRIPTION OF THE PREFERRED EMBODIMENT

Figure 1:
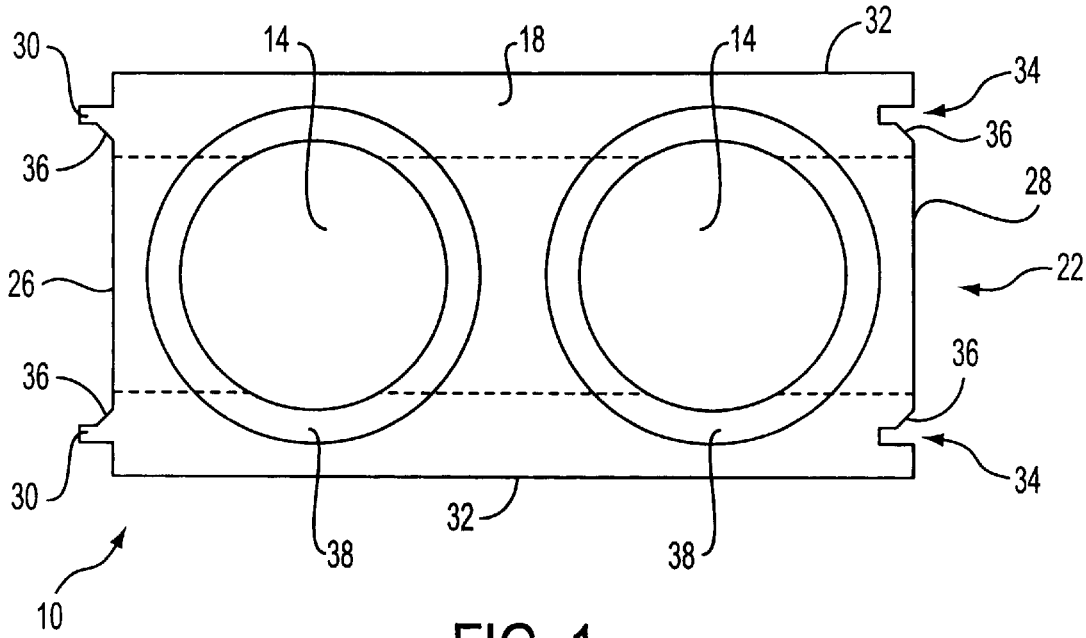
FIG. 1 is a top view of a brick of this invention having two vertical passageways.
Figure 2:
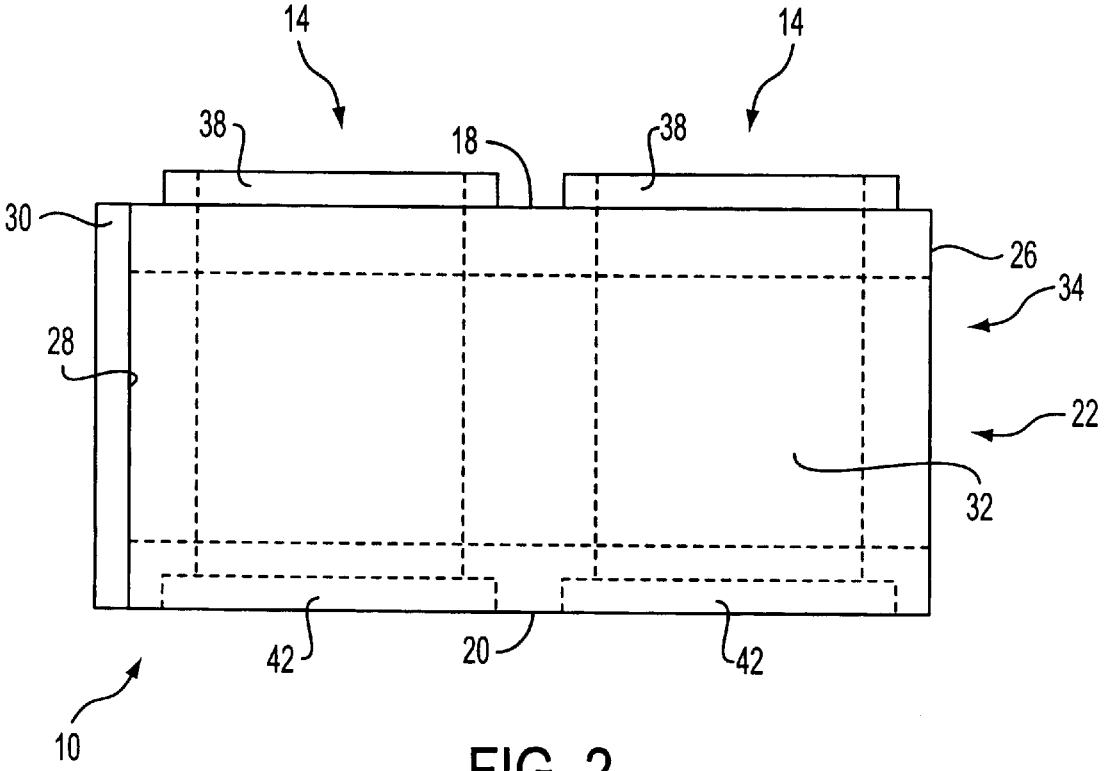
FIG. 2 is a side view of the brick illustrated in FIG. 1.
Figure 3:
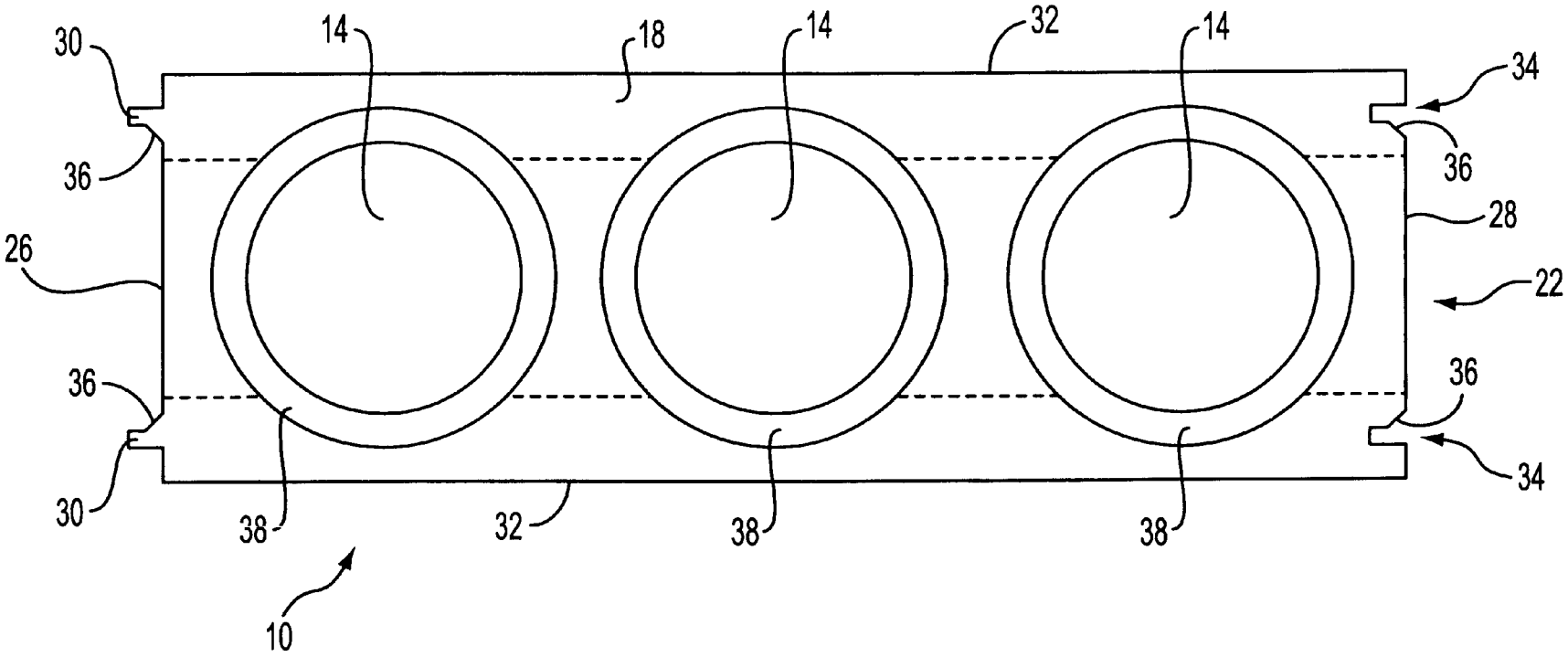
FIG. 3 is a top view of a brick of this invention having three vertical passageways.
Figure 4:
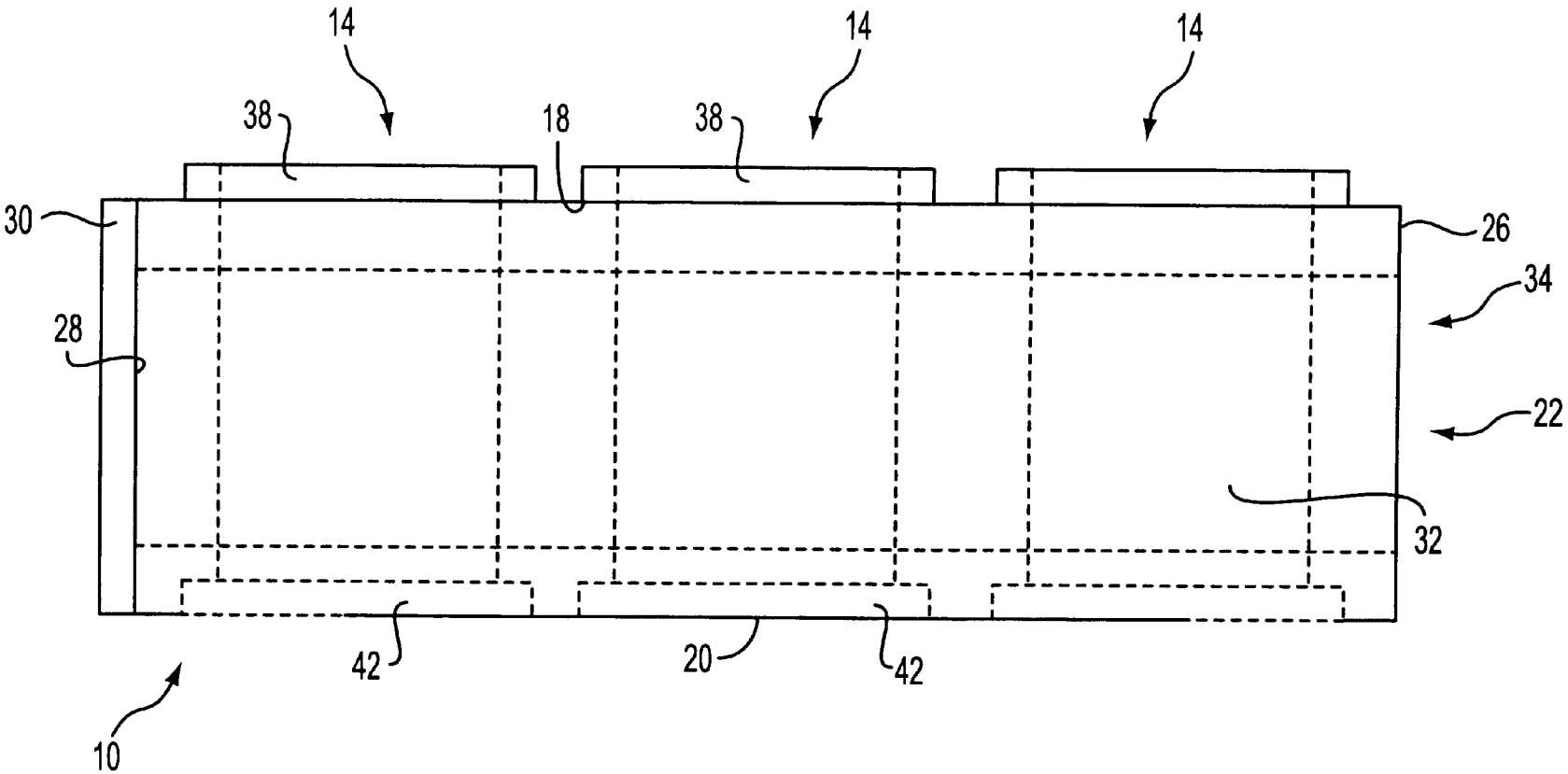
FIG. 4 is a side view of the brick illustrated in FIG. 3.

Referring to FIGS. 1, 2, 3 and 4, it will be seen that the brick 10 of this invention has preferably two or three cylindrical passageways or bores 14 running from the top 18 to the bottom 20 and a cylindrical passageway or bore 22 running from one end 26 to the opposite end 28. These bores 14, 22 intersect. The width and height of a standard brick is about half its length. In this invention, all bricks 10 preferably have a square cross-ssection. The width and height of the bricks 10 with two vertical passageways 14 are about half the length. The width and height of the bricks 10 with three vertical passageways 14 are about one third the length. Also, the bricks 10 with three vertical passageways 14 are about one third longer than the bricks 10 with two vertical passageways 14.

The brick 10 of this invention also has, preferably, two linear grooves 34 at one end 26 and two linear projections 30 at the other end 28 which are spaced apart from the bore 26, are of identical shape, and preferably run parallel to the sides 32. However, the grooves 34 are slightly larger than the projections 30. The projections 30 and grooves 34 run from top 18 to bottom 20 and are preferably designed with a break 36 for ease of assembly. There are annular projections 38 centered around the bores 14 at the top 18 and annular grooves 42 centered around the bores 14 at the bottom 20. These projections 38 and grooves 42 are of identical shape but again the grooves 42 are slightly larger than the projections 38. While all projections 30, 38 and grooves 34, 42 are illustrated in the Figures as having sharp corners, it will be appreciated that all corners could be rounded for ease of fabrication and assembly of the bricks 10.

Figure 5:
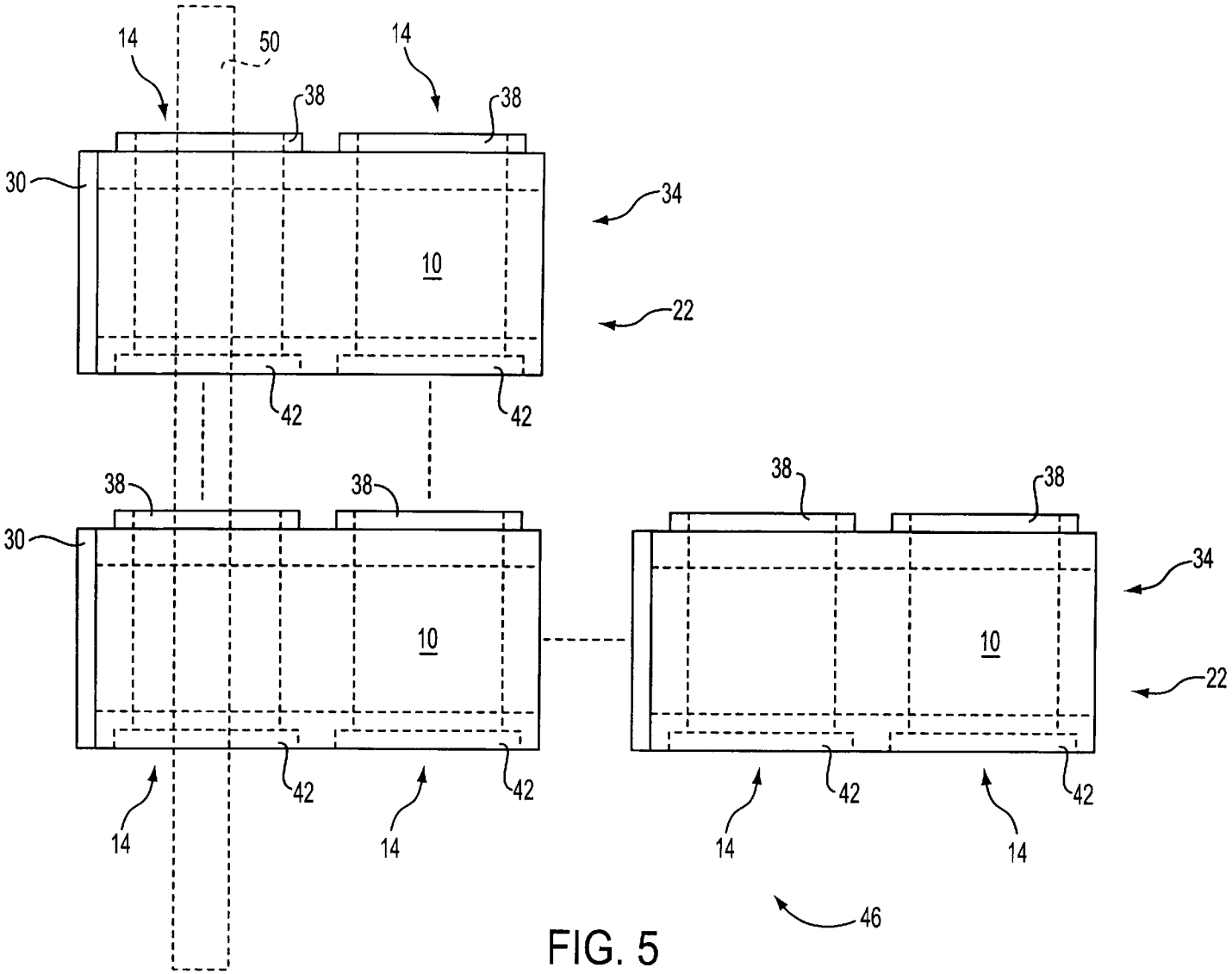
FIG. 5 is a partial, exploded view of a wall construction using bricks of this invention having two vertical passageways.
Figure 6:
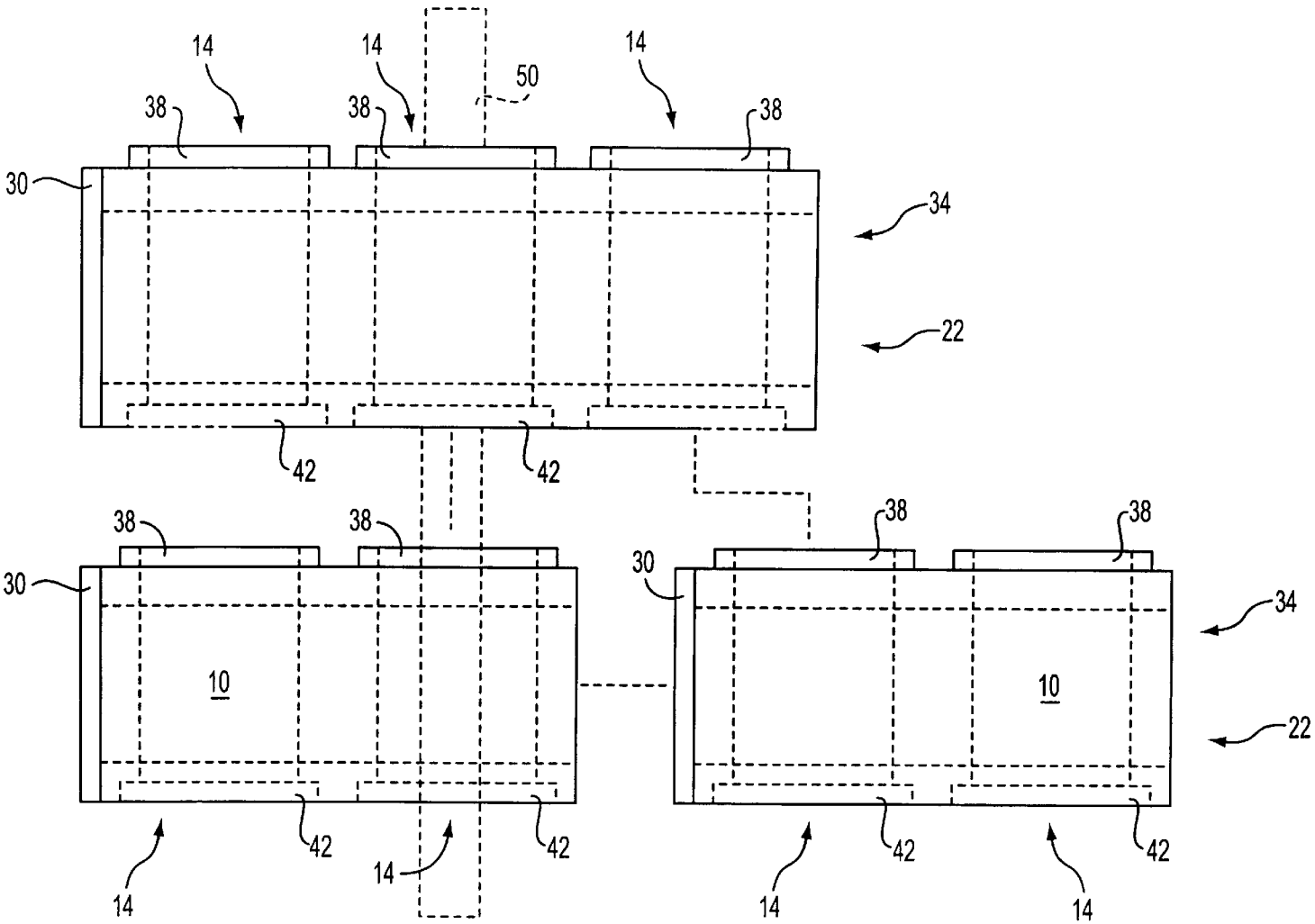
FIG. 6 is a partial, exploded view of another type of wall construction using bricks of this invention having two and three vertical passageways.

FIGS. 5 and 6 illustrate wall 46 construction using bricks 10 of this invention. It can be seen from these views that bricks 10 can be assembled in usual fashion with the bricks 10 vertically aligned or offset by half or one third a brick 10 in each course. The top to bottom bores 14 run in the vertical plane and the end to end bores 22 run in the horizontal plane. As the bricks 10 are assembled into a wall 46, the linear projections 30 from one brick 10 interlock with the linear grooves 34 of the adjacent brick 10. In addition, the annular projections 38 of one brick 10 interlock with the annular grooves 42 of another brick 10. The linear grooves 34 and projections 30 interlock horizontally and the annular grooves 42 and projections 38 interlock vertically. In this way, the bricks 10 interlock in two orthogonal planes and the wall 46 achieves strength and rigidity in two dimensions. Also, a network of interconnecting horizontal 22 and vertical 14 passageways is created within the wall 46. No mortar is needed between courses or bricks 10. The bricks 10 will simply interlock rigidly without the need for mortar.

Figure 7A:
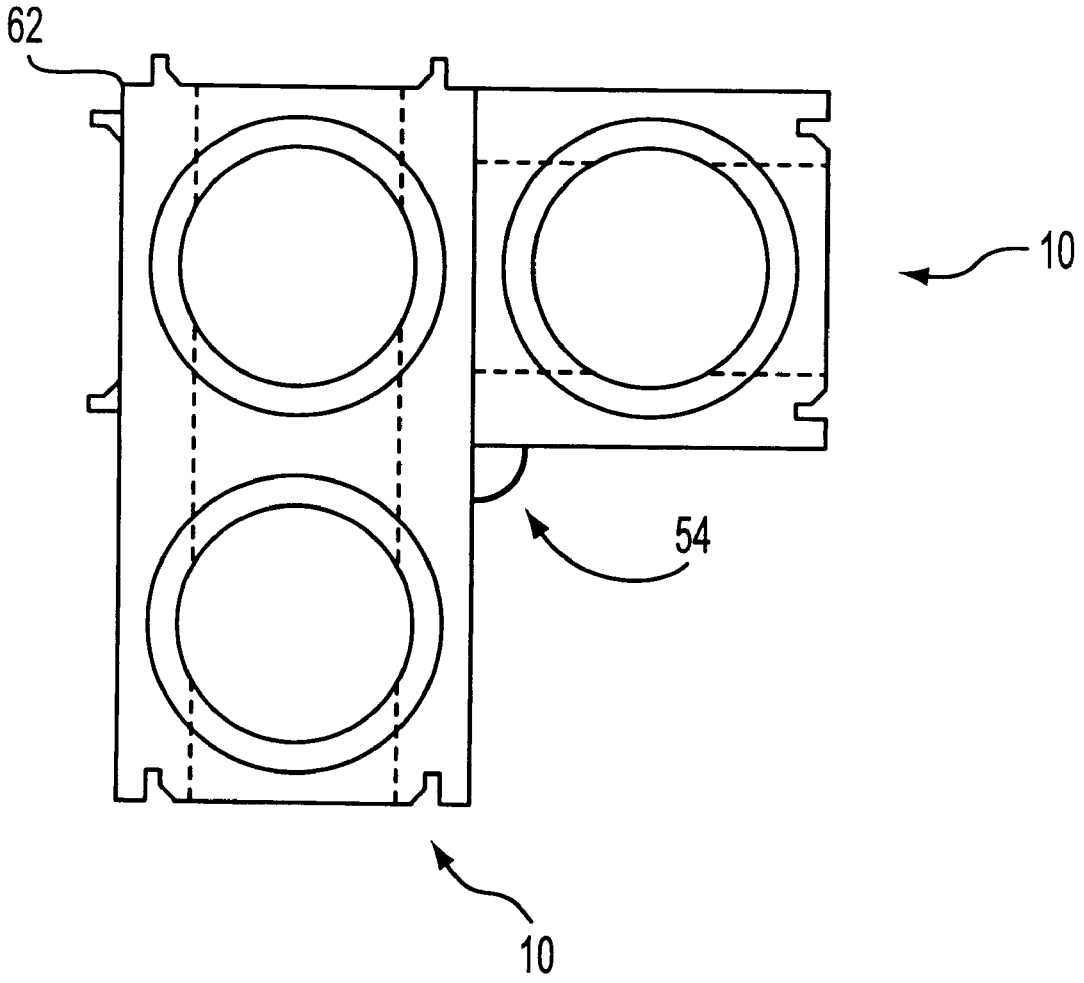
FIGS. 7A–7F are top views of wall corners.
Figure 7B:
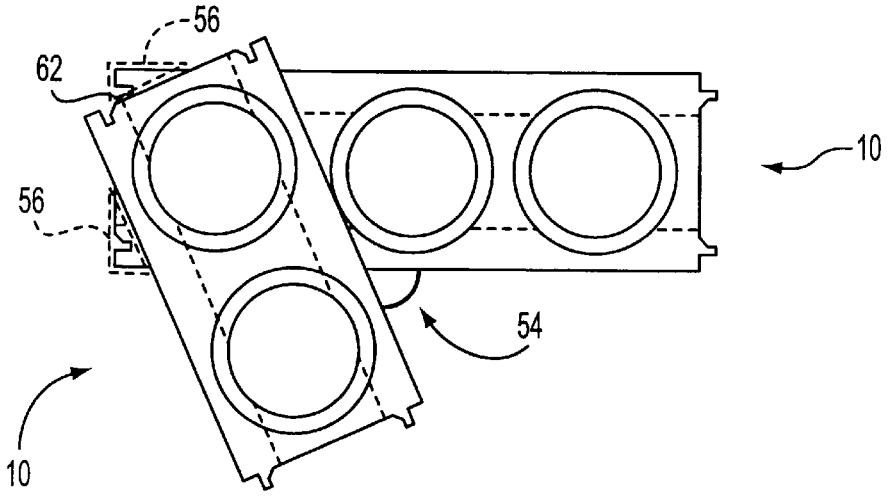
Figure 7C:
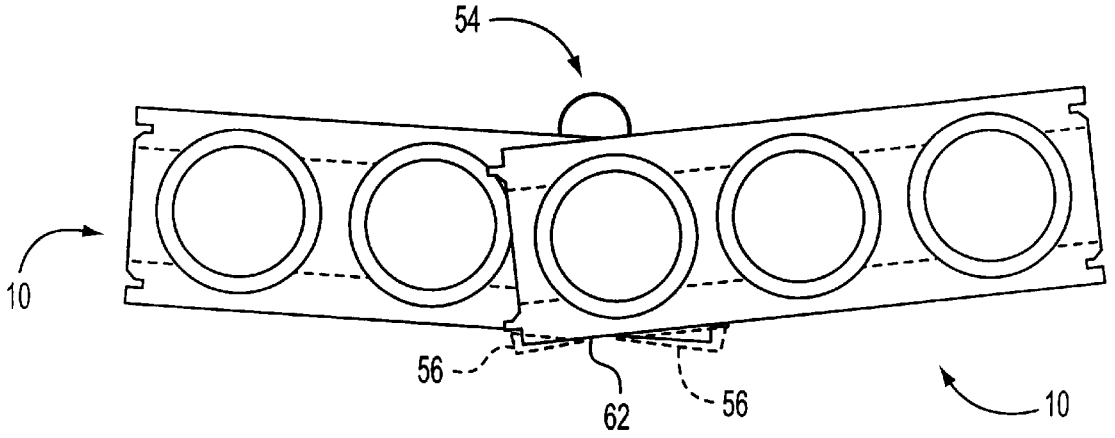
Figure 7D:
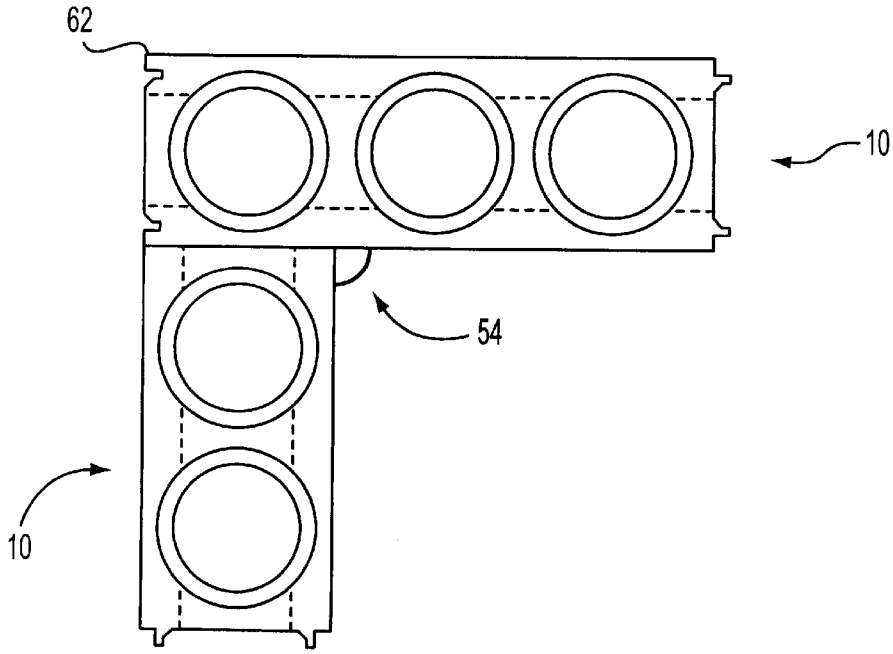
Figure 7E:
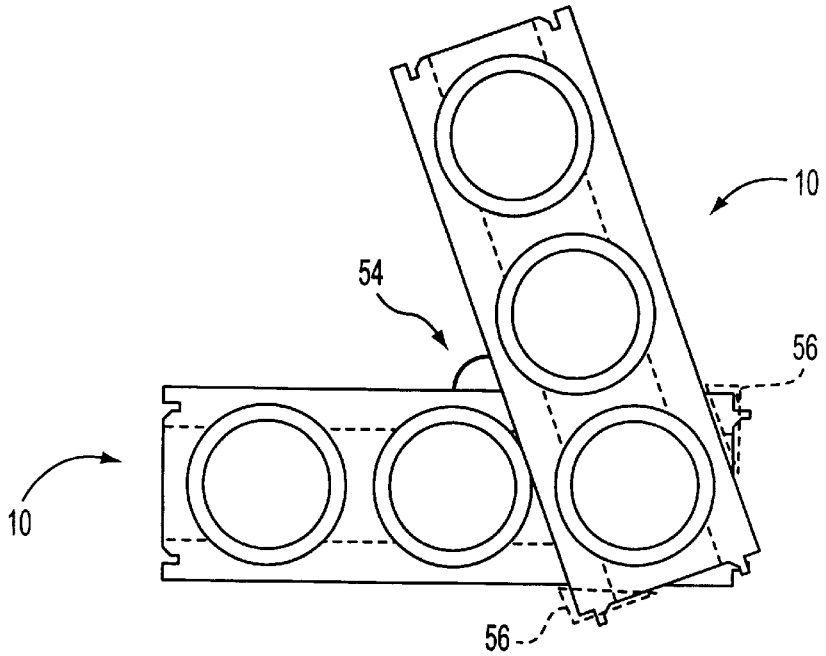
Figure 7F:
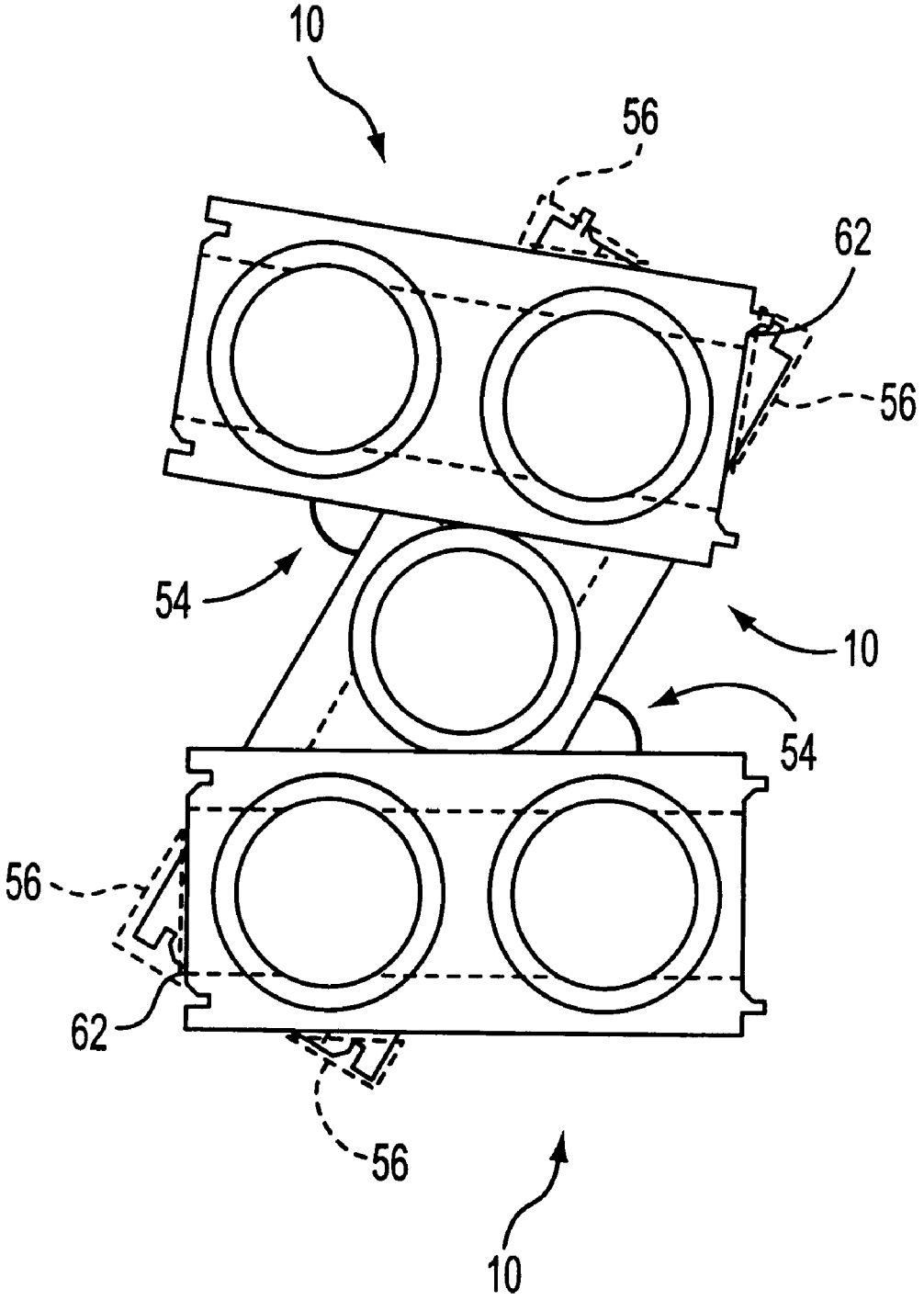

Since the annular projections 38 and the annular grooves 42 are all of a circular cross-section, bricks 10 can be assembled at any desired corner angle 54. This is illustrated on FIGS. 7A–7F. FIGS. 7A–7F each show a top view of two or more bricks 10 mated vertically via the annular grooves 42 and projections 38, at various corner angles 54. In FIGS. 7A–7E one brick in an upper course and one brick in the next lower course are illustrated. In FIG. 7F two bricks in an an upper course and one brick in the next lower course are illustrated. The corners 56 of bricks 10 assembled in the illustrative configurations shown in FIGS. 7B, 7C, 7E and 7F could be cut in order to provide smooth constructions at the wall corners 62. Also, it will be necessary to insert, partial, angularly trimmed bricks (not illustrated) in the courses in order to fill interstices created in the walls 46 between the courses at the wall corners 62.

To provide additional strength or rigidity to the wall, it can be built over reinforcing rods or posts 50 in conventional manner. Preferably, the reinforcing posts 50 should be smaller than the vertical bore 14. See FIGS. 5 and 6. Alternatively or additionally, the bores 14, 22 in the wall can be filled with concrete.

The interconnecting passageways 14, 22 can also be used to run plumbing or electric supply lines and the like. Such utilities can be installed in the wall 46 as it is being constructed.

It will be appreciated that the brick 10 of this invention can be used to simply and economically construct walls 46, leading to cheaper construction costs and thus cheaper housing costs.

While bricks 10 with two and three vertical passageways 14 have been illustrated, it is theoretically possible to fabricate bricks 10 with any number of vertical passageways 14. In order to ensure proper mating, the length of such bricks would increase by an amount equal to the width or height of the brick 10 with each added passageway 14. However, bricks 10 with two and three vertical passageways 14 would be the most useful. While the words "top" and "bottom" have been used for convenience in understanding this invention, it will be readily understood that what side of the bricks 10 in a wall 46 is up is immaterial.

The following reference numerals are used on FIGS. 1 through 7F:

10 Brick

14 Vertical or first bore or passageway

18 Top of brick

20 Bottom of brick

22 End to end, horizontal or second bore or passageway

26 End of brick

28 Opposite end of brick

30 Linear projection

32 Side of brick

34 Linear groove

38 Annular projection

42 Annular groove

46 Wall

50 Reinforcing post

54 Corner angle

56 Brick corner

62 Wall corner

The bidirectionally interlocking, hollow brick 10 wall system has been described with reference to a particular embodiment. Other modifications and enhancements can be made without departing from the spirit and scope of the claims that follow.

What is claimed is:

1. A bidirectionally interlocking, hollow wall system comprising an assembly of bricks each having: a first bore running from top to bottom; a second bore, intersecting said first bore, running from one end to the opposite end; a linear groove in said one end, running from top to bottom, spaced apart from said second bore; a linear projection, projecting from said opposite end, running from top to bottom, spaced apart from said second bore; an annular groove centered about said first bore in said top; and an annular projection centered about said first bore projecting from said bottom; said linear groove and linear projection designed to mate; said annular groove and annular projection designed to mate to allow for rotation; whereby a plurality of said bricks can be assembled to create walls meeting at a desired corner angle.

2. A bidirectionally interlocking, hollow wall system comprising an assembly of bricks each having: a square cross-section; a length equal to twice its width; two spaced apart first bores each running from top to bottom; a second bore, intersecting said first bores, running from one end to the opposite end; a linear groove in said one end, running from top to bottom spaced apart from said second bore; a linear projection projecting from said opposite end, running from top to bottom spaced apart from said second bore; two annular grooves each centered about each of said first bores in said top; and two annular projections each centered about each of said first bores projecting from said bottom; said linear groove and linear projection designed to mate; said annular grooves and annular projections designed to mate to allow for rotation; whereby a plurality of said bricks can be assembled to create walls meeting at a desired corner angle.

3. A bidirectionally interlocking, hollow wall system as claimed in claim 2 in which bricks in successive courses are offset.

4. A bidirectionally interlocking, hollow wall system comprising an assembly of bricks each having: a square cross-section; a length equal to three times its width; three spaced apart first bores each running from top to bottom; a second bore, intersecting said first bores, running from one end to the opposite end; a linear groove in said one end, running from top to bottom spaced apart from said second bore; a linear projection projecting from said opposite end, running from top to bottom spaced apart from said second bore; three annular grooves each centered about each of said first bores in said top; and three annular projections each centered about each of said first bores projecting from said bottom; said linear groove and linear projection designed to mate; said annular grooves and annular projections designed to mate to allow for rotation; whereby a plurality of said bricks can be assembled to create walls meeting at a desired corner angle.

5. A bidirectionally interlocking, hollow wall system as claimed in claim 4 in which bricks in successive courses are offset.

6. A bidirectionally interlocking, hollow wall system comprising an assembly of first bricks and second bricks, designed to mate with each other; said bricks having a square cross-section;

said first brick having: a length equal to twice its width; two spaced apart first bores each running from top to bottom; a second bore, intersecting said first bores, running from one end to the opposite end; a linear groove in said one end, running from top to bottom spaced apart from said second bore; a linear projection projecting from said opposite end, running from top to bottom spaced apart from said second bore; two annular grooves each centered about each of said first bores in said top; and two annular projections each centered about each of said first bores projecting from said bottom; said linear groove and linear projection designed to mate; said annular grooves and annular projections designed to mate to allow for rotation;

said second brick having: a length three times its width; three spaced apart first bores each running from top to bottom; a second bore, intersecting said first bore, running from one end to the opposite end; a linear groove in said one end, running from top to bottom spaced apart from said second bore; a linear projection projecting from said opposite end, running from top to bottom spaced apart from said second bore; three annular grooves each centered about each of said first bores in said top; and three annular projections each centered about each of said first bores projecting from said bottom; said linear groove and linear projection designed to mate; said annular grooves and annular projections designed to mate to allow for rotation;

whereby a plurality of said bricks can be assembled to create walls meeting at a desired corner angle.

7. A method of fabricating a bidirectionally interlocking, hollow wall system comprising the steps of:

a providing a plurality of bricks; each brick having: a first bore running from top to bottom; a second bore, intersecting said first bore, running from one end to the opposite end; a linear groove in said one end, running from top to bottom, spaced apart from said second bore; a linear projection, projecting from said opposite end, running from top to bottom, spaced apart from said second bore; an annular groove centered about said first bore in said top; and an annular projection centered about said first bore projecting from said bottom; said linear groove and linear projection designed to mate to allow for rotation; said annular groove and annular projection designed to mate; and b assembling said bricks to create a wall with interconnecting passageways in two planes.

8. A method as claimed in claim 7 in which said wall includes a wall corner with a desired corner angle.

9. A method as claimed in claim 8 further comprising the step of cutting the corners off said bricks in order to create a smooth wall at said wall corners.

10. A method as claimed in claim 8 further comprising the step of inserting partial bricks at said wall corners in order to fill any oddly shaped interstices.

11. A method as claimed in claim 7 further comprising the step of setting posts of diameter less than the size of said first bore in the ground with appropriate spacing and building said wall over said posts.

12. A method as claimed in claim 7 further comprising the step of filling said interconnecting passageways with concrete.

13. A method as claimed in claim 7 further comprising the step of filling said interconnecting passageways with plumbing and electrical supply lines.

14. A method of fabricating a bidirectionally interlocking, hollow wall system comprising the steps of:

a providing a plurality of bricks; each brick having: a square cross-section; a length equal to twice its width; two spaced apart first bores each running from top to bottom; a second bore, intersecting said first bores, running from one end to the opposite end; a linear groove in said one end, running from top to bottom spaced apart from said second bore; a linear projection projecting from said opposite end, running from top to bottom spaced apart from said second bore; two annular grooves each centered about each of said first bores in said top; and two annular projections each centered about each of said first bores projecting from said bottom; said linear groove and linear projection designed to mate; said annular grooves and annular projections designed to mate to allow for rotation; and b assembling said bricks to create a wall with interconnecting passageways in two planes.

15. A method as claimed in claim 14 in which bricks in successive courses are offset.

16. A method as claimed in claim 14 in which said wall includes a wall corner with a desired corner angle.

17. A method as claimed in claim 16 further comprising the step of cutting the corners off said bricks in order to create a smooth wall at said wall corners.

18. A method as claimed in claim 16 further comprising the step of inserting partial bricks at said wall corner in order to fill any oddly shaped interstices.

19. A method as claimed in claim 14 further comprising the step of setting posts of diameter less than the size of said first bore in the ground with appropriate spacing and building said wall over said posts.

20. A method as claimed in claim 14 further comprising the step of filling said interconnecting passageways with concrete.

21. A method as claimed in claim 14 further comprising the step of filling said interconnecting passageways with plumbing and electrical supply lines.

22. A method of fabricating a bidirectionally interlocking, hollow wall system comprising the steps of:

a providing a plurality of bricks; each brick having: a square cross-section; a length equal to three times its width; three spaced apart first bores each running from top to bottom; a second bore, intersecting said first bores, running from one end to the opposite end; a linear groove in said one end, running from top to bottom spaced apart from said second bore; a linear projection projecting from said opposite end, running from top to bottom spaced apart from said second bore; three annular grooves each centered about each of said first bores in said top; and three annular projections each centered about each of said first bores projecting from said bottom; said linear groove and linear projection designed to mate; said annular grooves and annular projections designed to mate to allow for rotation; and b assembling said bricks to create a wall with interconnecting passageways in two planes.

23. A method as claimed in claim 22 in which bricks in successive courses are offset.

24. A method as claimed in claim 22 in which said wall includes a wall corner with a desired corner angle.

25. A method as claimed in claim 24 further comprising the step of cutting the corners off said bricks in order to create a smooth wall at said wall corner.

26. A method as claimed in claim 24 further comprising the step of inserting partial bricks at said wall corner in order to fill any oddly shaped interstices.

27. A method as claimed in claim 22 further comprising the step of setting posts of diameter less than the size of the first bores in the ground with appropriate spacing and building said wall over said posts.

28. A method as claimed in claim 22 further comprising the step of filling said interconnecting passageways with concrete.

29. A method as claimed in claim 22 further comprising the step of filling said interconnecting passageways with plumbing and electrical supply lines.

30. A method of fabricating a bidirectionally interlocking, hollow wall system comprising the steps of:

a providing a plurality of first bricks; each first brick having: a square cross-section; a length equal to twice its width; two spaced apart first bores each running from top to bottom; a second bore, intersecting said first bores, running from one end to the opposite end; a linear groove in said one end, running from top to bottom spaced apart from said second bore; a linear projection projecting from said opposite end, running from top to bottom spaced apart from said second bore; two annular grooves each centered about each of said first bores in said top; and two annular projections each centered about each of said first bores projecting from said bottom; said linear groove and linear projection designed to mate; said annular grooves and annular projections designed to mate to allow for rotation;

b providing a plurality of second bricks; each second brick having: a length three times its width; three spaced apart first bores each running from top to bottom; a second bore, intersecting said first bore, running from one end to the opposite end; a linear groove in said one end, running from top to bottom spaced apart from said second bore; a linear projection projecting from said opposite end, running from top to bottom spaced apart from said second bore; three annular grooves each centered about each of said first bores in said top; and three annular projections each centered about each of said first bores projecting from said bottom; said linear groove and linear projection designed to mate; said annular grooves and annular projections designed to mate to allow for rotation; said first bricks and second bricks, designed to mate with each other; and c assembling said bricks to create a wall with interconnecting passageways in two planes.

31. A method as claimed in claim 30 in which said wall includes a wall corner with a desired corner angle.

32. A method as claimed in claim 31 further comprising the step of cutting the corners off said first and second bricks in order to create a smooth wall at said wall corner.

33. A method as claimed in claim 31 further comprising the step of inserting partial bricks at said wall corner in order to fill any oddly shaped interstices.

34. A method as claimed in claim 30 further comprising the step of setting posts of diameter less than the size of said first bore in the ground with appropriate spacing and building said wall over said posts.

35. A method as claimed in claim 30 further comprising the step of filling said interconnecting passageways with concrete.

36. A method as claimed in claim 30 further comprising the step of filling said interconnecting passageways with plumbing and electrical supply lines.

* * * * *